US006234048B1

(12) United States Patent
Carmien

(10) Patent No.: US 6,234,048 B1
(45) Date of Patent: May 22, 2001

(54) NONRECOIL HAMMER

(76) Inventor: Joseph Allen Carmien, 525 N. Maple Dr., Beverly Hills, CA (US) 90210

( * ) Notice: Subject to any disclaimer, the term of this patent is extended or adjusted under 35 U.S.C. 154(b) by 0 days.

(21) Appl. No.: 09/586,841

(22) Filed: Jun. 5, 2000

Related U.S. Application Data

(63) Continuation-in-part of application No. 09/236,851, filed on Jan. 25, 1999, now abandoned.

(51) Int. Cl.[7] ..... B25D 1/00
(52) U.S. Cl. ..... 81/22; 30/308.1
(58) Field of Search ..... 81/20, 22; 30/308.1

(56) References Cited

U.S. PATENT DOCUMENTS

| | | |
|---|---|---|
| Re. 32,364 | 2/1987 | Carmien . |
| 404,663 | 6/1889 | Thompson et al. . |
| 657,422 | 9/1900 | Judd . |
| 894,155 | 7/1908 | Layton . |
| 1,374,336 | 4/1921 | Surbaugh . |
| 1,435,851 | 11/1922 | Isham . |
| 1,755,236 | 4/1930 | Brandenburg . |
| 2,031,556 | 2/1936 | Brandenburg . |
| 2,052,616 | 9/1936 | Gardes . |
| 2,063,774 | 12/1936 | Washington . |
| 2,205,769 | 6/1940 | Sweetland . |
| 2,238,104 | 4/1941 | Finley . |
| 2,517,902 | 8/1950 | Luebkeman . |
| 2,837,381 | 6/1958 | Sarlandt . |
| 2,850,331 | 9/1958 | Curry et al. . |
| 2,948,649 | 8/1960 | Pancherz . |
| 3,018,140 | 1/1962 | Portz et al. . |
| 3,232,355 | 2/1966 | Woolworth . |
| 3,549,189 | 12/1970 | Alosi . |
| 3,556,888 | 1/1971 | Goldsworthy . |
| 3,620,159 | 11/1971 | Gould . |
| 3,753,602 | 8/1973 | Carmien . |
| 3,762,453 | 10/1973 | Merrow et al. . |
| 3,819,288 | 6/1974 | Carmien . |
| 3,762,453 | 10/1973 | Merrow et al. . |

(List continued on next page.)

FOREIGN PATENT DOCUMENTS

| | | |
|---|---|---|
| 1064418 | 5/1954 | (FR) . |
| 25555098 | 5/1985 | (FR) . |
| 3424 | 7/1882 | (GB) . |
| 1376180 | 1/1972 | (GB) . |
| 2093398A | 9/1982 | (GB) . |
| 129611 | 10/1950 | (SE) . |
| PCT/SE84/0036 | 8/1984 | (WO) . |

*Primary Examiner*—D. S. Meislin
(74) *Attorney, Agent, or Firm*—Kelly Bauersfeld Lowry & Kelley, LLP

(57) ABSTRACT

An improved nonrecoil or deadblow hammer and related production method are provided, wherein the hammer has a tool head of hardened steel or the like formed with a hollow socket containing a filler material adapted to shift in the direction of an impact blow struck by the hammer to absorb or dissipate shock forces and thereby substantially reduce or eliminate tool head rebound. The tool head comprises a central body having, for example, a conventional impact member and a nail removal claw formed at opposite ends thereof. The hollow socket is formed in the central body and is upwardly open for seated reception of a hollow canister containing the filler material, such as a flowable and relatively high mass filler material in the form of small steel pellets. In a preferred configuration, the canister is preassembled with a tool handle which extends downwardly from the tool head through a handle port formed at the base or lower end of the socket. In an alternative preferred form, the filler material is a solid slug of selected high mass mounted within the canister and having a size to shift in the direction of an impact blow to absorb or dissipate shock forces. The solid slug movably shifts along a guide rail within the canister, wherein the guide rail prevents the shifting slug from applying a load due to centrifugal force to the top of the canister during swinging of the hammer to strike a blow.

16 Claims, 7 Drawing Sheets

U.S. PATENT DOCUMENTS

| | | | |
|---|---|---|---|
| 3,819,288 | 6/1974 | Carmien . | |
| 3,874,433 | 4/1975 | Shepherd, Jr. et al. . | |
| 3,877,826 | 4/1975 | Shepherd, Jr. et al. . | |
| 3,915,782 | 10/1975 | Davis et al. . | |
| 3,917,421 | 11/1975 | Carmien et al. . | |
| 4,030,847 | 6/1977 | Carmien . | |
| 4,039,012 | 8/1977 | Cook . | |
| 4,050,727 | 9/1977 | Bonnes . | |
| 4,085,784 | 4/1978 | Fish . | |
| 4,139,930 | 2/1979 | Cox . | |
| 4,287,640 | 9/1981 | Keathley . | |
| 4,291,998 | 9/1981 | Santos . | |
| 4,367,979 | 1/1983 | Milligan . | |
| 4,404,708 | 9/1983 | Winter . | |
| 4,424,183 | 1/1984 | Nelson . | |
| 4,451,073 | 5/1984 | Carmien . | |
| 4,570,988 | 2/1986 | Carmien . | |
| 4,605,254 | 8/1986 | Carmien . | |
| 4,639,029 | 1/1987 | Kolonia . | |
| 4,697,481 | 10/1987 | Maeda . | |
| 4,743,481 | 5/1988 | Quinlan et al. . | |
| 4,831,901 | 5/1989 | Kinne | 81/20 X |
| 5,031,272 | 7/1991 | Carmien . | |
| 5,056,381 | 10/1991 | Carmien . | |
| 5,123,304 | 6/1992 | Carmien . | |
| 5,262,113 | 11/1993 | Carmien . | |
| 5,375,486 | 12/1994 | Carmien . | |
| 5,537,896 | 7/1996 | Holder | 81/22 X |
| 5,916,338 | 6/1999 | Bergkvist et al. | 81/22 |
| 5,960,677 | 10/1999 | Carmien | 81/22 |

NONRECOIL HAMMER

RELATED APPLICATION

This is a continuation-in-part of U.S. patent application Ser. No. 09/236,851, filed Jan. 25, 1999 now abandoned.

BACKGROUND OF THE INVENTION

This invention relates generally to improvements in impact type hand tools such as hammers and mallets and the like, and to related processes for manufacturing such hand tools. More particularly, this invention relates to an improved hammer of the type having a tool head of hardened steel or the like, such as a carpenter's framing hammer, wherein the tool head contains a movable filler material to provide the hammer with nonrecoil or deadblow characteristics during normal use.

Hammers of the type have a tool head defining one or more metal impact members are well known in the art, for use in striking a target or work surface. In this regard, such hammers are available in a broad range of tool head sizes, shapes and weights in accordance with the particular task or tasks to be performed, such as driving nails or breaking concrete. Since marking or other damage to the target surface is frequently not an issue, the tool head is commonly constructed from a tough grade and preferably hardened steel to provide durable impact members for extended service life. One example of such hammers comprises a conventional carpenter's framing hammer having a hardened steel tool head with a central aperture or eyehole for assembly with a tool handle, wherein the tool head defines an impact member and a nail removal claw at opposite ends thereof. The tool head of such framing hammer is used for a variety of tasks, including driving nails, removal of nails, and other prying and wedging functions.

One problem encountered with traditional hammers of the type having a metal tool head relates to hammer rebound or recoil from a target surface after striking an impact blow. More specifically, when the hammer is swung by a worker to strike a target surface, most of the kinetic energy is transmitted from the impact member of the hammer to the target surface at the moment of impact. However, a portion of this kinetic energy is not transmitted to the target surface, but instead causes the hard-faced tool head to rebound or recoil from the target surface. This rebound effect thus prevents complete or substantially complete energy transfer to the target surface, thereby typically requiring an increased number of impact blows to perform a given task, e.g., driving a nail. Alternately, this rebound effect requires the worker to swing the hammer with an increased force, or to use a hammer with a heavier tool head, in order to complete a task with a reduced number of impact blows. Moreover, the worker must maintain a grasp of the hammer following an impact blow with sufficient strength to resist rebound forces in order to prevent loss of control. All of these factors undesirably increase the degree of strength and skill required for proper and safe hammer usage.

Nonrecoil or so-called deadblow hammers have been developed in an attempt to reduce or eliminate rebound of the tool head from a target surface following an impact blow. Such nonrecoil or deadblow hammers typically have a tool head defined by a hollow core canister filled partially with a relatively high mass and flowable filler material such as steel shot pellets, steel pins, or the like. In many designs, the hollow canister is protectively encased in whole or in part within a molded jacket or cladding constructed from a selected tough and durable thermoplastic material such as nylon. In use, when the tool head is impacted with a target surface, the filler material shifts and slides about within the hollow canister to absorb and dissipate the impact force in a manner which effectively counteracts any resultant rebound force. As a result, a greater proportion of the kinetic energy is transmitted from the tool head to the target surface in the course of each blow, to permit performance of a given task in a reduced number of blows, or alternately to permit use of a hammer having a lighter tool head. In addition, less strength and skill are required to control the hammer following each blow. For examples, of such nonrecoil impact tools, see U.S. Pat. Nos. 5,262,113 and 5,375,486. However, nonrecoil hammers have generally been limited to mallets and the like having relatively soft impact faces designed to avoid marking or damage to the target surface, or alternately to include metal-faced caps designed to mount upon a tool head formed primarily from relatively soft or nonmetallic materials. Such hammers have generally been ill-suited for use, for example, in a typical carpentry or framing environment wherein a hardened steel tool head is desired.

The present invention relates to an improved hammer or other striking tool of the type having a rigid tool head of hardened steel or the like to define at least one hard-faced impact member, wherein the tool head contains a flowable or movable filler material of relatively high mass to provide the hammer with substantial nonrecoil characteristics following an impact blow to a target surface.

SUMMARY OF THE INVENTION

In accordance with the invention, an improved nonrecoil or deadblow hammer and related production method are provided, wherein a tool head of hardened steel or the like is formed with a hollow socket containing a movable and relatively high mass filler material adapted to absorb or dissipate shock forces and thereby substantially reduce or eliminate rebound when an impact blow is struck by the hammer. The tool head comprises a central body having at least one impact member formed thereon for striking a target surface, wherein the central body has the hollow socket formed therein for seated reception of a hollow canister containing the movable filler material, such as a flowable filler material in the form of small steel pellets. The canister may be preassembled with a tool handle which extends downwardly from the tool head through a handle port formed at the base or lower end of the socket.

More specifically, in accordance with a preferred form of the invention, the tool head formed from hardened steel or the like defines the hollow socket which opens upwardly for nested and substantially seated reception of the hollow canister containing the movable filler material. The canister defines an opposing pair of end faces seated respectively in substantial abutting relation with a matingly shaped pair of end walls lining the opposite ends of the socket. These end walls within the socket are formed respectively at the inboard sides of front and rear tool work members, such as a front impact member and a cleft-shaped rear nail removal claw in the case of a carpenter's framing hammer.

The canister is preferably preassembled with a tool handle which in one form may be constructed as a fiberglass pultrusion and then assembled with the canister as by encasing all or part of the canister and handle within a suitable thermoplastic molded cladding. Such hollow canister preassembled with a tool handle is shown and described, for example, in U.S. Pat. Nos. 5,262,113 and 5,375,486, which are incorporated by reference herein. The canister is partially filled with the movable filler material, and seated within the upwardly open socket formed in the tool head. In this position, the tool handle extends downwardly from the tool head through the handle port formed in the base or lower end of the socket. Lock means such as a cap plate may be attached to the tool head for enclosing and retaining the canister within the socket. In one preferred form, the movable filler material comprises a flowable material such as a quantity of small steel shot pellets or the like.

In use, upon swinging of the hammer to strike one of the took work members such as the front impact member against a target surface, the movable filler material within the canister shifts in the direction of the impact blow to absorb and dissipate shock forces in a manner which focuses the impact energy upon the target surface while reducing or eliminating any significant rebound. In this regard, the canister containing the filler material is tightly constrained within its opposite end faces seated against the inboard end walls of the tool head lining the socket, resulting in efficient energy transfer between the canister and the tool head.

In an alternative preferred form of the invention, the movable filler material comprises a solid slug of selected and relatively high mass, and having a size and shape for movement back and forth within the canister generally along an impact axis aligned generally with the direction of an impact blow struck by the hammer. In this embodiment, a guide rail within the canister restricts the solid slug to shifting movement generally along the impact axis, and thereby prevents the shifting slug from applying a load due to centrifugal force to the top of the canister during swinging of the hammer to strike an impact blow. In a preferred geometry, the guide rail comprises a guide pin extending within the canister generally along the impact axis, and received through a similarly aligned guide port or track formed in the solid slug.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
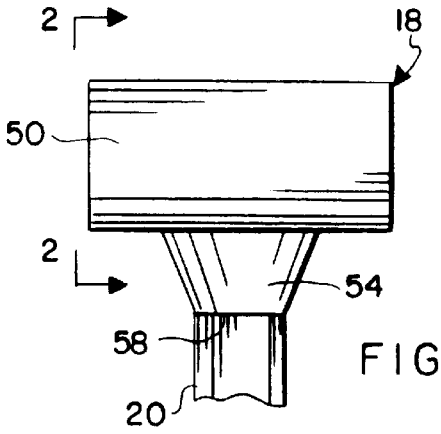
FIG. 1 is a fragmented side elevational view depicting a hollow canister preassembled with a tool handle, for use in constructing the improved nonrecoil hammer of the present invention.
Figure 2:
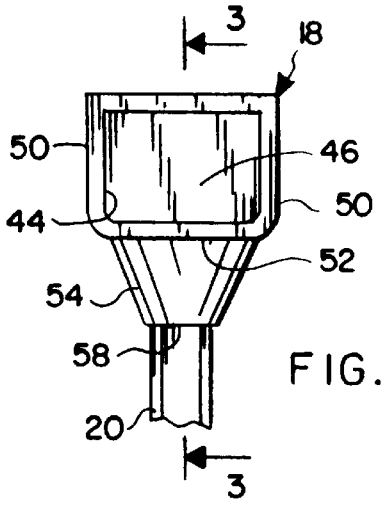
FIG. 2 is a fragmented front elevational view of the preassembled canister and tool handle of FIG. 1, taken generally on the line 2—2 of FIG. 1.
Figure 3:
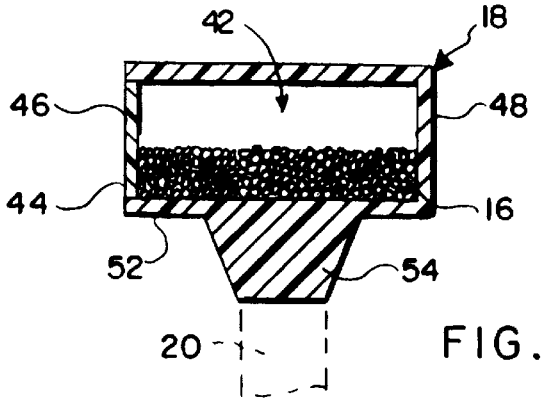
FIG. 3 is a fragmented longitudinal vertical sectional view of the preassembled canister and tool handle, taken generally on the line 3—3 of FIG. 2.
Figure 4:
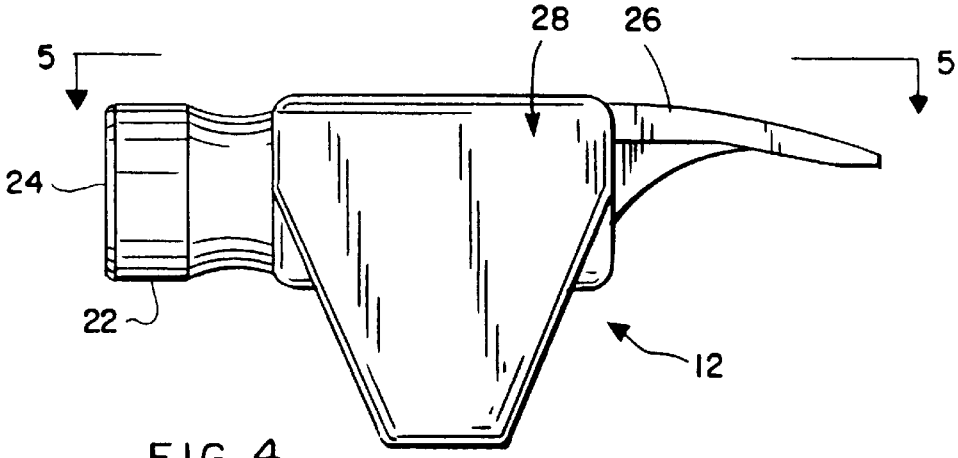
FIG. 4 is a side elevational view of a tool head, for use in constructing the improved nonrecoil hammer of the present invention.
Figure 5:
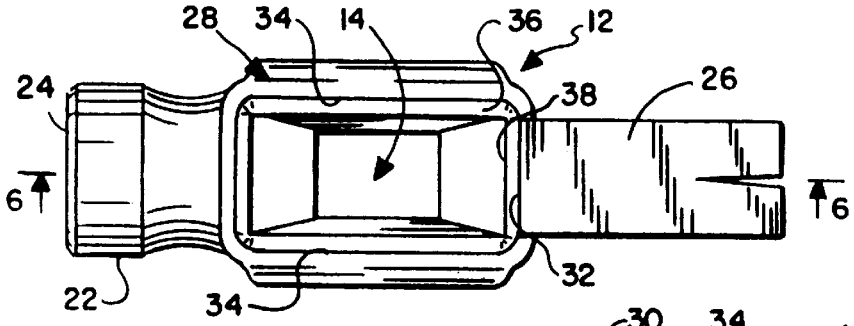
FIG. 5 is a top plan view of the tool head of FIG. 4, taken generally on the line 5—5 of FIG. 4.
Figure 6:
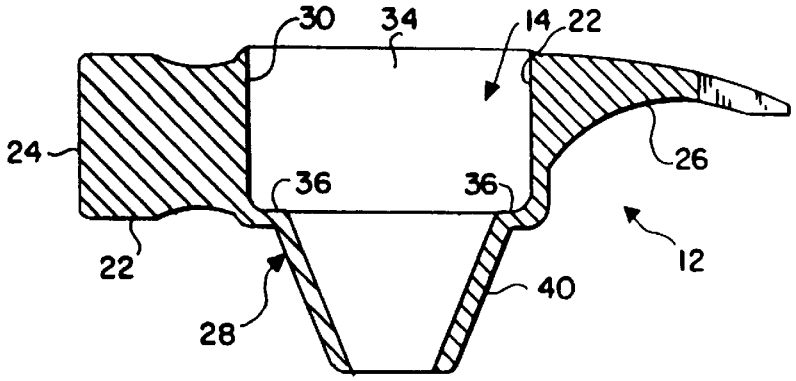
FIG. 6 is a longitudinal vertical sectional view of the tool head, taken generally on the line 6—6 of FIG. 5.
Figure 7:
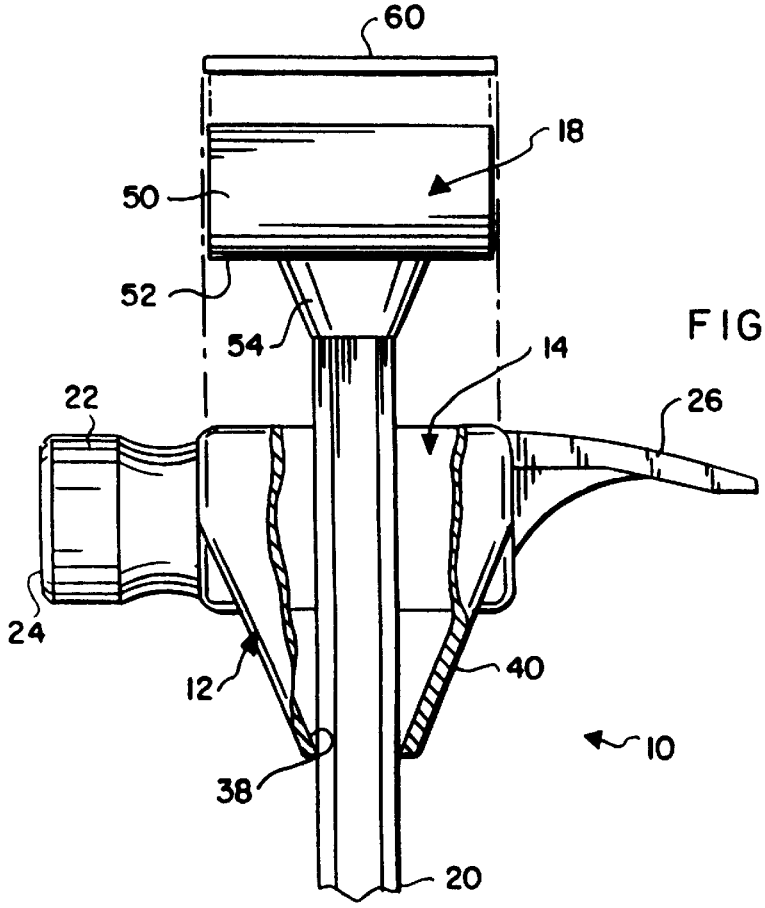
FIG. 7 is an exploded and fragmented side elevational view illustrating assembly of the canister and tool handle with the tool head.
Figure 8:
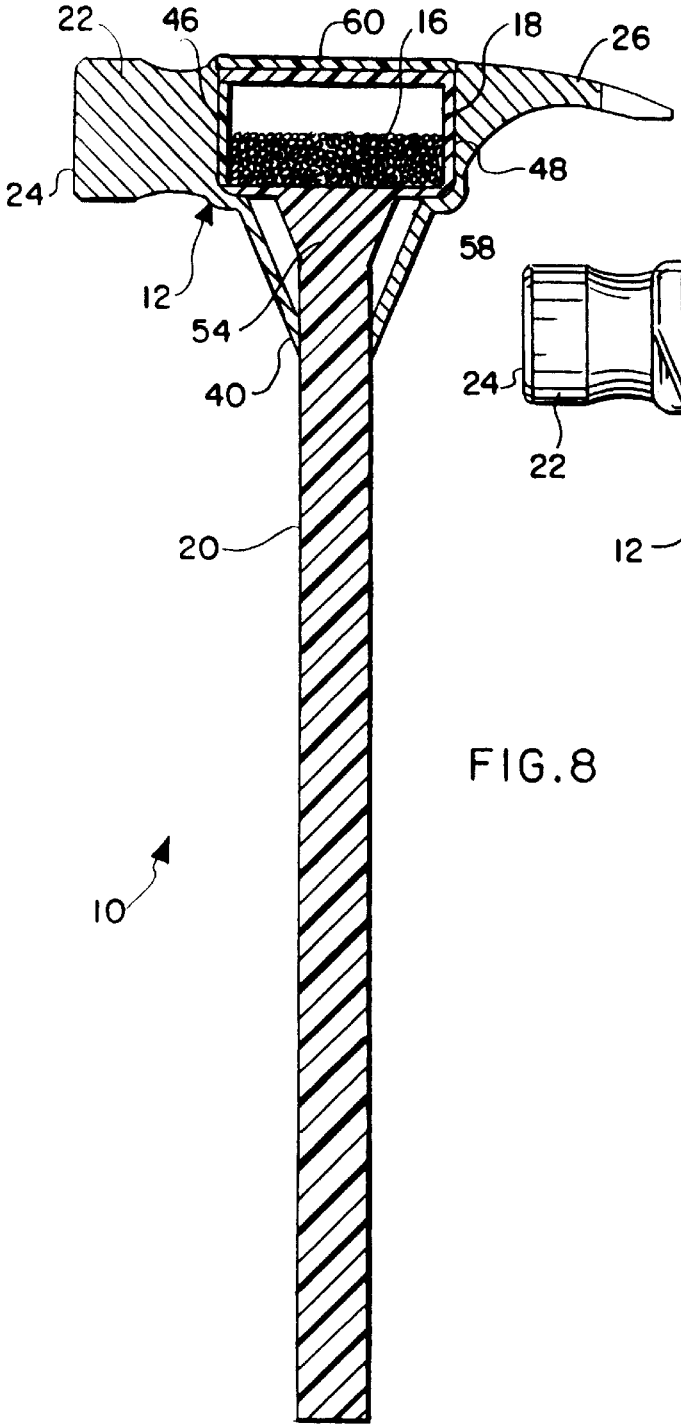
FIG. 8 is a vertical sectional view illustrating the canister and tool handle in assembled relation with the tool head.
Figure 9:
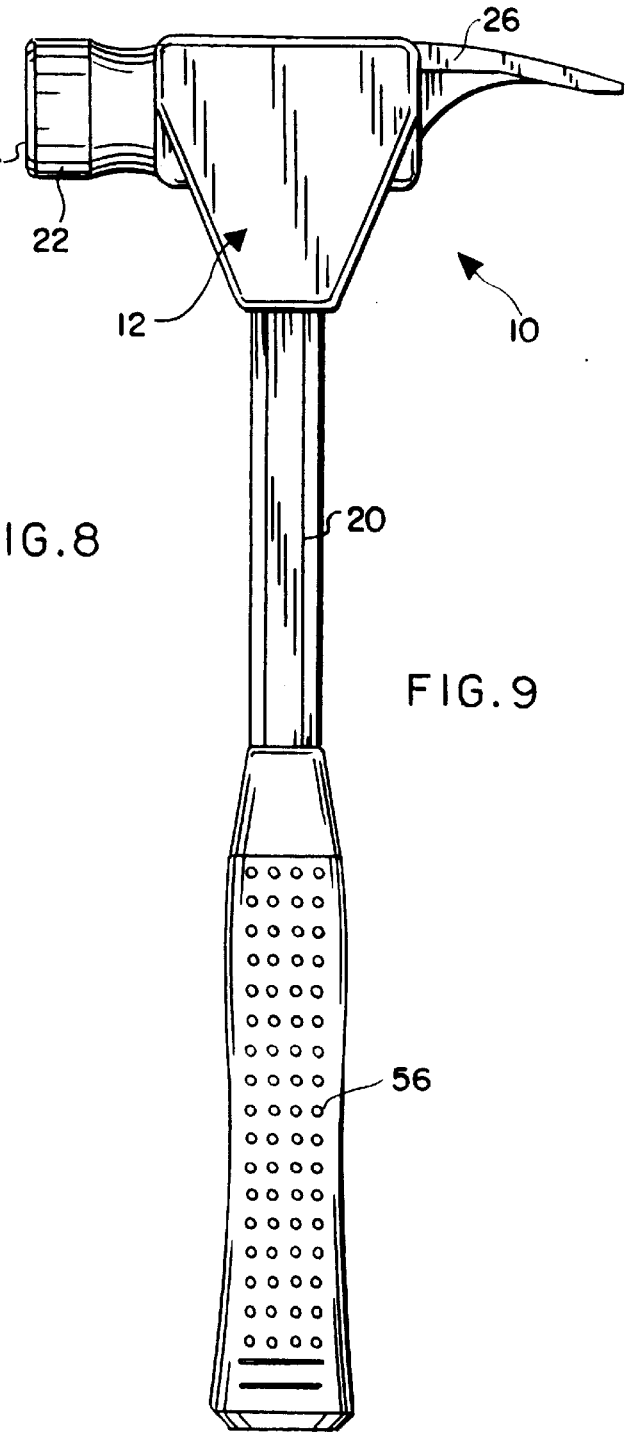
FIG. 9 is a side elevational view of the improved nonrecoil hammer constructed according to the present invention.

As shown in the exemplary drawings, an improved nonrecoil or deadblow hammer referred to generally in FIGS. 7–9 by the reference numeral 10 includes a tool head 12 of the type formed from a hard and preferably metal material such as hardened steel. This tool head 12 has an open socket 14 (FIG. 7) formed therein to receive and contain a relatively high mass movable filler material 16 (FIG. 8), such as a flowable filler material formed by steel shot pellets or the like, to provide the hammer 10 with substantial nonrecoil or deadblow characteristics during normal use. In one preferred form, and in accordance with a preferred method of assembly, the movable filler material 16 is contained within a hollow canister 18 (FIG. 7 and 8) which is preassembled with a tool handle 20, followed by seated fitting of the canister 18 into the socket 14 formed in the hard metal tool head 12.

The improved hammer 10 of the present invention is designed for use the broad range of manually operated impact tool tasks wherein a hard metal tool head may be preferred or required, and further wherein potential marking or damage to a target surface in response to impact blows is not a significant concern. In this regard, the illustrative drawings show the tool head 12 in a geometry to include front and rear work members in the form of a front impact member 22 defining a hard-surfaced impact face 24, and a rear cleft-shaped nail removal claw 26, in conformance with the construction of a conventional so-called carpenter's framing hammer. Such framing hammer desirably includes the front impact member 22 and the rear claw 26 of relatively hard steel for performing a range of tasks such as nail driving and nail pulling. In addition, in a hammer of this type, it is also desirable for the remainder of the tool head 12 to be constructed from a rigid and hard material such as a hardened steel body formed integrally with the front and rear work members 22, 26 so that the hammer can also be used for a variety of other tasks, including but not limited to wedging, prying, etc. The present invention provides the improved hammer 10 with all of these desirable characteristics, but in addition provides the hammer with beneficial nonrecoil or deadblow characteristics for improved delivery of the energy of an impact blow to a target surface with reduced hammer rebound and resultant reduced worker fatigue.

The tool head 12 is shown in FIGS. 4–7 to include a central body 28 having the front impact member 22 and the rear nail removal claw 26 formed at opposite ends thereof. In a preferred construction, the tool head 12 is formed as a unitary metal structure, preferably from a hardened steel. The central body 28 has the socket 14 formed therein with an upwardly open configuration. As shown best in FIGS. 5 and 6, this socket 14 comprises a relatively large and upwardly open cavity of generally rectangular shape lined by upstanding front and rear end walls 30 and 32, and by a pair of upstanding side walls 34. The front and rear end walls 30, 32 are disposed generally in axial alignment with and thus define inboard end walls for the front and rear work members 22, 26 of the hammer.

The base or lower end of the socket 14 is defined by a peripheral rim 36 extending inwardly from the lower ends of the end walls 30, 32 and the adjoining side walls 34. This peripheral rim 36 defines a support surface for seated and secure nested reception of the canister 28, as will be described in more detail. The rim 36 merges in turn with a downwardly open handle port 38 defined in the illustrative drawings by a downwardly extending hollow skirt 40 of generally truncated conical shape formed as part of the tool head 12 in substantial alignment with a vertical center axis of the overlying socket 14. The cross sectional area defined by the handle port 38 is significantly smaller that the cross sectional area defined by the open upper or top end of the socket 14.

As shown in FIGS. 1–3 and 8, the canister 18 comprises a generally rectangular hollow case or core having a size and shape for nested and substantially mated reception into the socket 14 of the tool head 12. More specifically, the canister 18 may be formed from a suitable sturdy material such as a selected metal or molded plastic, to have a hollow interior 42 (FIG. 3) and initially to include at least one opening such as an open front end 44 (FIGS. 3 and 8) to permit partial filling of the canister with the relatively high mass movable filler material 16, e.g., a flowable filler material such as metal shot pellets or pins or the like. After placement of the filler material 16 into the canister 18, the opening 44 is closed, as by means of an end plate 46 suitably affixed over or nested within the canister front end. Importantly, the canister 18 is sized and shape to fit relatively tightly within the socket 14 as viewed in FIG. 8, with the front end plate 46 abutting the adjacent inboard front end wall 30 of the tool head, and with a rear end face 48 of the canister abutting the adjacent inboard rear end wall 32 of the tool head 12. In this regard, the front and rear end walls 30, 32 of the tool head 12 will normally be formed with a slight taper or draft extending upwardly and outwardly relative to the socket 14, and the front and rear faces 46, 48 of the assembled canister 18 will be formed with a mating taper or draft for tight abutting fit against the end walls 30, 32. A similar taper may be imparted to the socket side walls 34, in which case the side walls 50 of the canister 18 would be formed with a mating taper for tight abutting fit therewith.

A lower or bottom wall 52 of the canister 18 seats upon the peripheral rim 36 within the socket 14, when the canister is fully and properly inserted into the socket 14 as viewed in FIG. 8. In this position, a tapered stem 54 of truncated conical shape extends downwardly from the underside of the canister bottom wall 52, within the tool head skirt 40. This tapered stem 54 comprises a convenient structure for connection of the canister 18 to an upper end of the tool handle 20, wherein this connection is protectively located within and surrounded by the skirt 40, as shown best in FIG. 8. The tool handle 20 extends downwardly from the canister stem 54, through the handle port 38 defined by the skirt 40, for convenient manual grasping during hammer use. A resilient grip 56 (FIG. 9) may be mounted on a lower region of the tool handle 20.

In accordance with a preferred method of producing the improved hammer 10 of the present invention, the canister 18 is initially preassembled with the tool handle 20. In this regard, in the case of a metal canister structure, the canister stem 54 can be securely attached to the upper end of a metal tool handle by means of welding or the like, as a connection point indicated by reference numeral 58 (FIGS. 1–3 and 8). Alternately, in one preferred form utilizing a fiberglass tool handle 20 which may be constructed as by pultrusion according to U.S. Pat. Nos. 5,262,113 and 5,375,486, which are incorporated by reference herein, the canister 18 may be assembled with the tool handle 20 and encased in whole or in part within a suitable thermoplastic molded cladding (not shown). In such configuration, the molded cladding would normally leave the end faces 46, 48 of the canister exposed for subsequent intimate abutting engagement with the inboard end walls 30, 32 lining the tool head socket 14. In either construction, the flowable filler material 16 is placed into the hollow canister 18 prior to or following canister attachment to the tool handle 20, and the canister 18 is closed by means of the end plate 46 to seal the filler material therein.

The preassembled canister 18 and tool handle 20 are then assembled with the tool head 12 by sliding the handle 20 downwardly through the handle port 38 (FIG. 7) until the canister 18 is fully seated within the socket 14 (FIG. 8). In the fully seated position, the periphery of the canister bottom wall 52 is firmly seated upon the support rim 36 at the bottom of the socket 14, and the opposing end faces 46, 48 of the canister are is relatively tight and intimate abutting engagement with the inboard end walls 30, 32 lining the socket. In addition, a lower end of the skirt 40 is sized and shaped for relatively snug-fit sliding reception and support of the handle 20. A cap plate 60 (FIGS. 7 and 8) is then secured to the top of the tool head 12, as by welding or by use of a suitable adhesive material, to close the upper end of the socket 14 and thereby enclose the canister therein. The resilient hand grip 56 can then be mounted onto the lower region of the tool handle 20, if desired.

In use, the hammer 10 can be employed by a worker to perform any of the traditional impact, prying, etc., functions normally associated with a conventional carpenter's framing hammer. Upon striking an impact blow by swinging the front impact member 22 against a target surface, such as the head of a nail, the flowable filler material 16 within the tool head shifts in the direction of the blow at the moment of impact to focus the impact energy upon the target surface. As a result, little energy is available for causing any significant recoil or rebound of the hammer from the target surface following the impact blow. Accordingly, by applying an increased proportion of the impact energy to the target surface for each blow, the improved hammer of the present invention is beneficially capable of performing tasks with a reduced effort, either in terms of the number of blows or in terms of the force of each blow, in comparison with a conventional solid steel tool head hammer of comparable weight. Alternatively, the improved hammer of the present invention permits a hammer of lighter weight to be used. Moreover, the nonrecoil characteristics of the hammer 10 result in further reductions in worker effort and fatigue. Importantly, the hollow canister 18 is supported by the tool head 12 in a secure and stable manner, by virtue of the snug nested fit within the socket 14, in combination with the secondary support provided by the skirt 40 engaging the handle 20 at a point below the canister/handle connection site 58.

An alternative preferred form of the nonrecoil hammer of the present invention is shown in FIGS. 10–25, wherein components corresponding generally with those shown and described with respect to FIGS. 1–9 are identified by common reference numerals increased by 100. In the embodiment of FIGS. 10–25, a modified nonrecoil hammer 110 is depicted with a tool head 112 having a hollow socket 114 formed therein, wherein the movable filler material mounted within the tool head socket 114 comprises a solid slug 116 of relatively high mass. The solid slug 116 is sized and shaped to movably shift within the tool head 112 upon swinging the hammer to strike a blow, for purposes of focusing impact energy upon the target surface and for reducing hammer recoil or rebound. In comparison with the flowable filler material 16 shown and described with respect to the embodiment of FIGS. 1–9, the solid slug 116 provides a faster and more instantaneous delivery of impact energy to a target surface.

Figure 10:
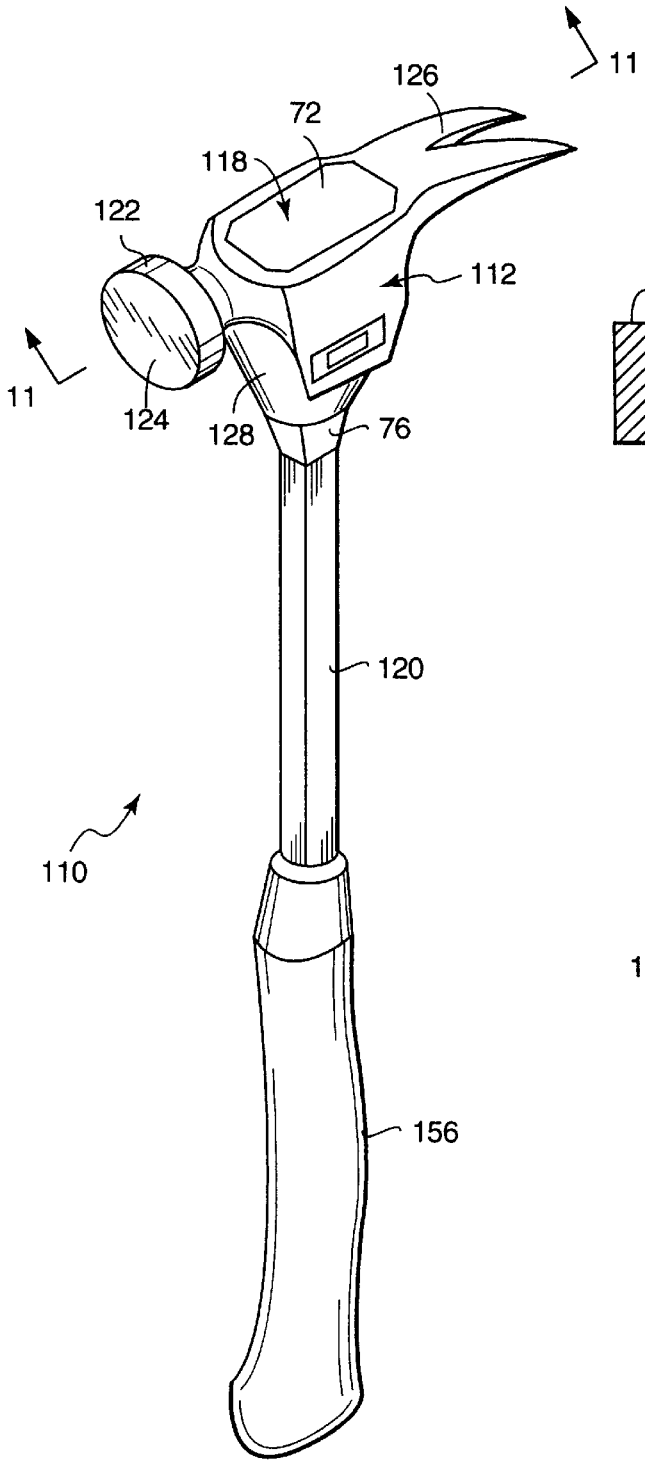
FIG. 10 is a perspective view of a hammer embodying an alternative preferred form of the invention.
Figure 11:
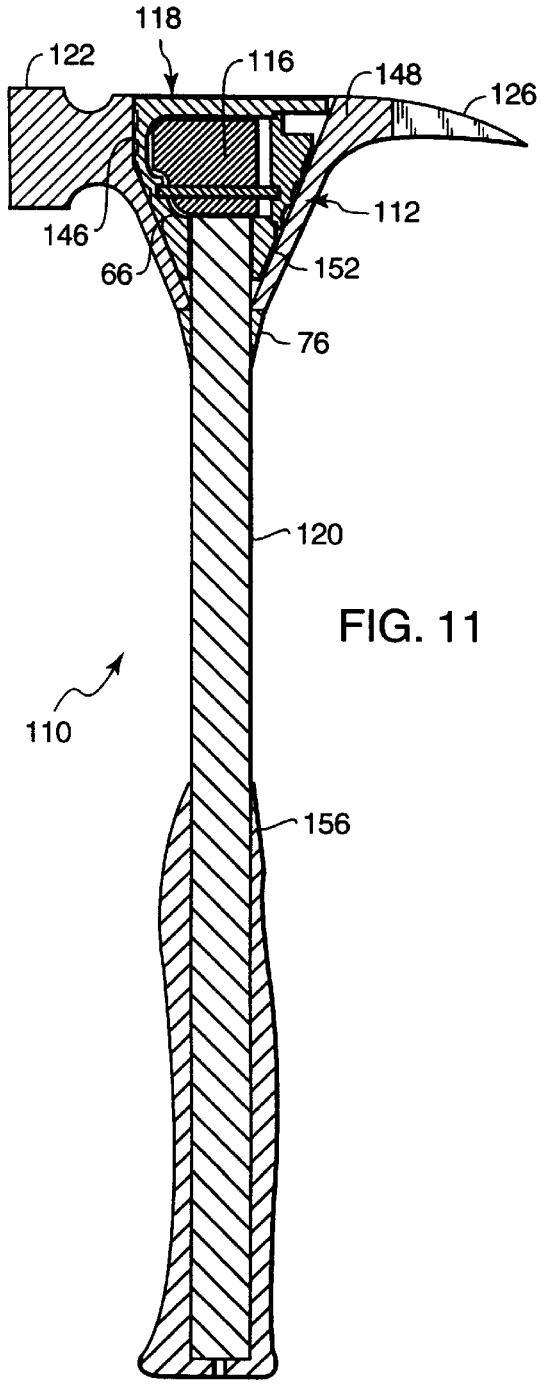
FIG. 11 is a vertical sectional view taken generally on the line 11—11 of FIG. 10.
Figure 12:
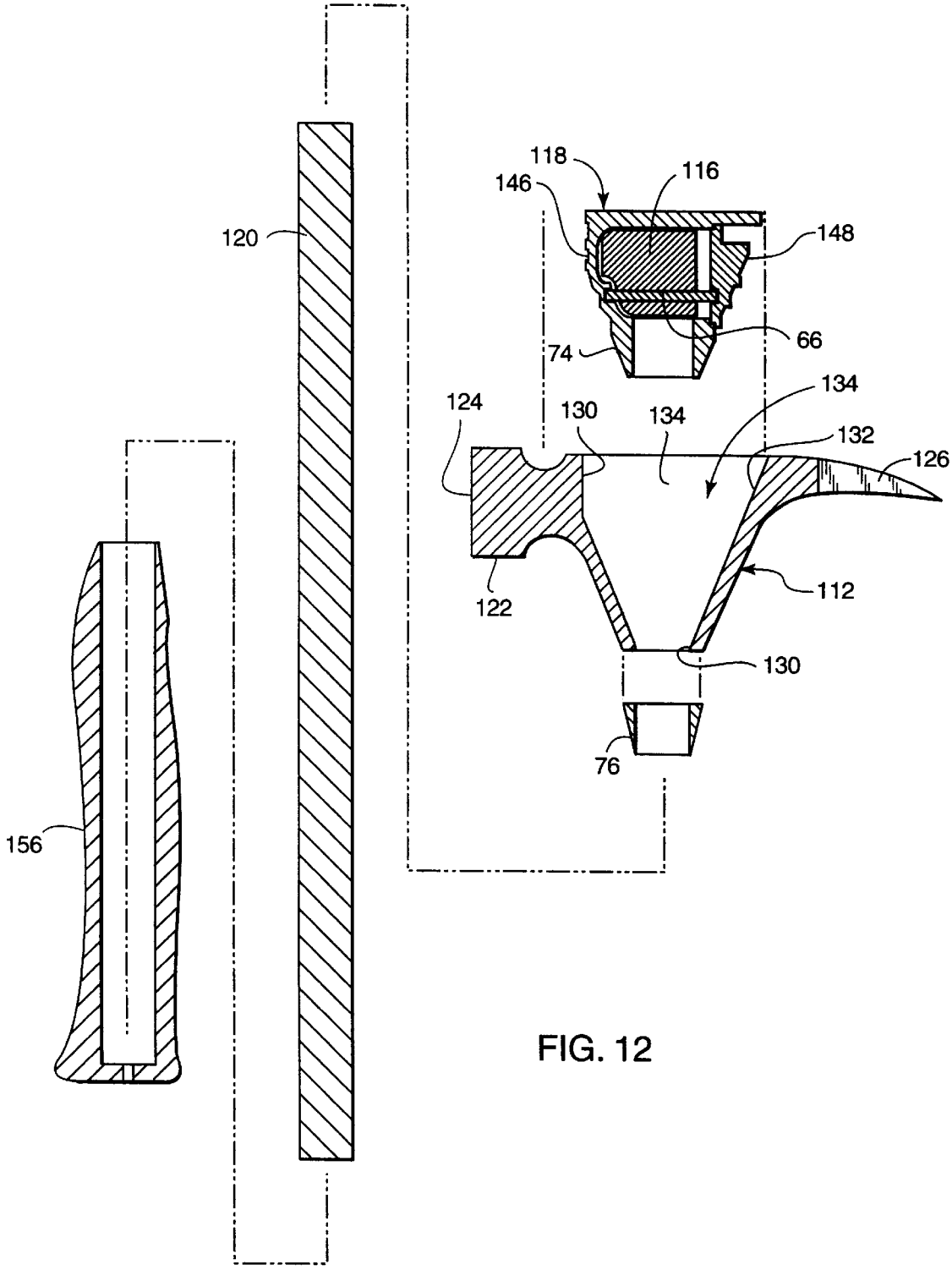
FIG. 12 is an exploded assembly view of the hammer shown in FIGS. 10–11, with components thereof being illustrated in vertical section.
Figure 13:
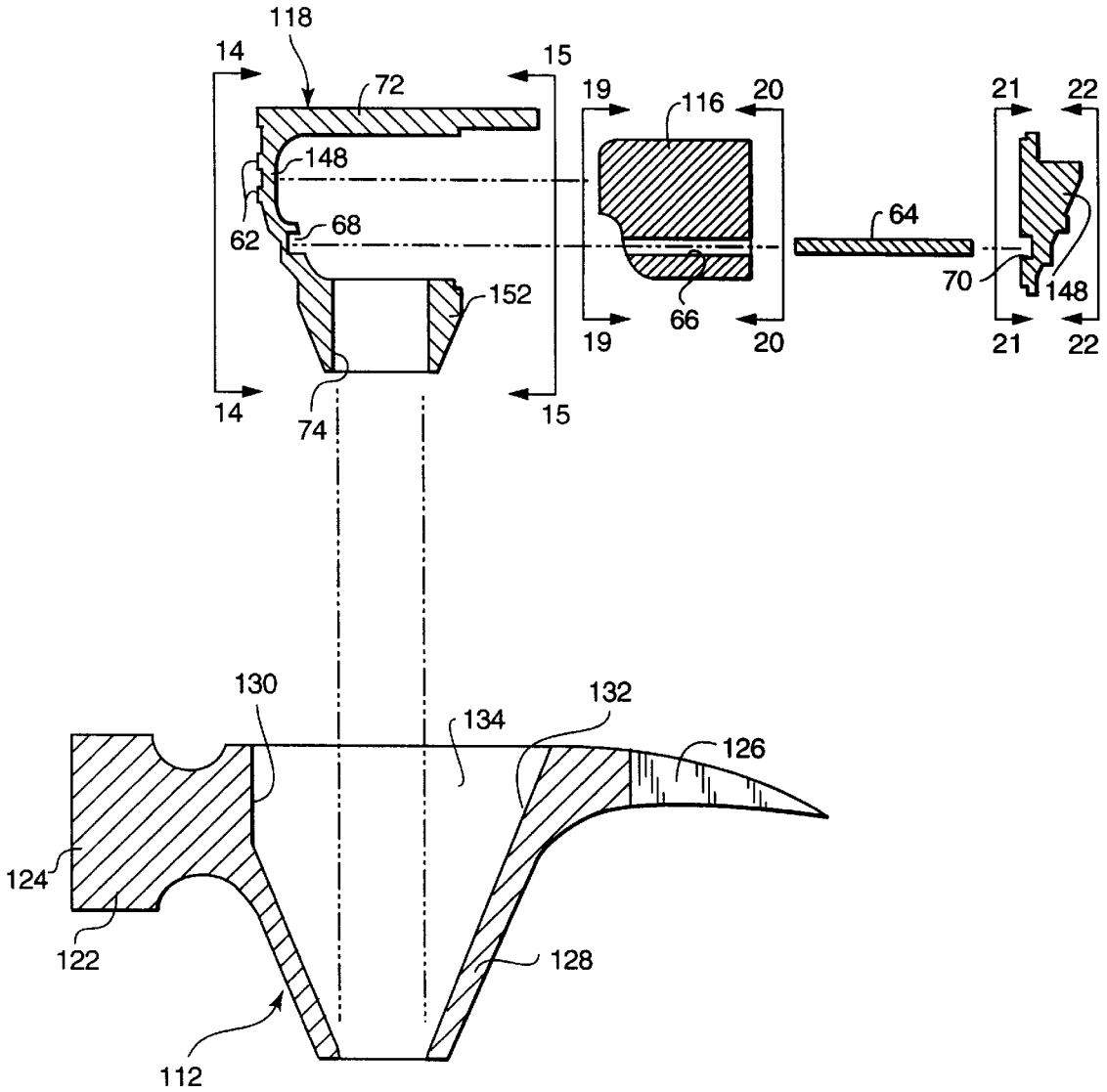
FIG. 13 is an enlarged exploded assembly view corresponding generally with a portion of FIG. 12, and showing assembly of a solid slug within a canister for mounting in turn within a tool head.
Figure 17:
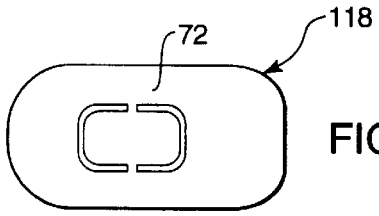
FIG. 17 is a top plan view of the canister, taken generally on the line 17—17 of FIG. 16.
Figure 14:
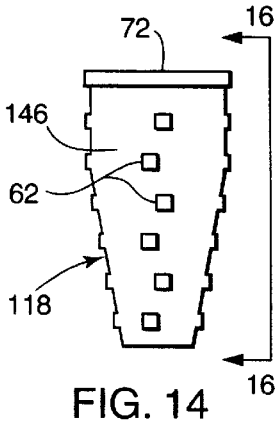
FIG. 14 is a front elevation view of the canister, taken generally on the line 14—14 of FIG. 13.
Figure 16:
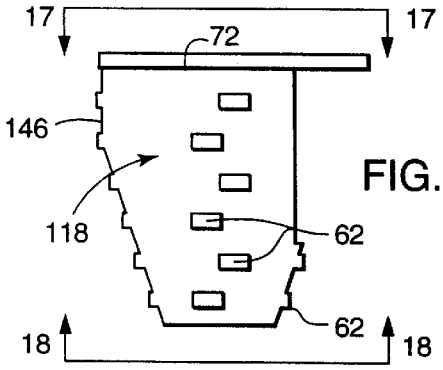
FIG. 16 is a side elevation view of the canister, taken generally on the line 16—16 of FIG. 14.
Figure 15:
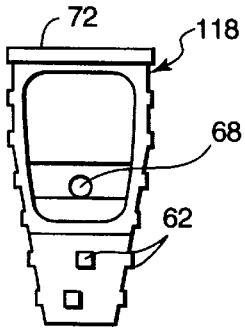
FIG. 15 is a rear elevation view of the canister, taken generally on the line 15—15 of FIG. 13.
Figure 18:
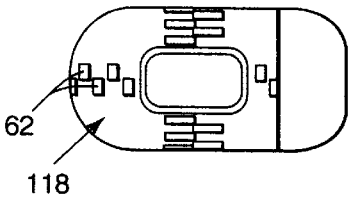
FIG. 18 is a bottom plan view of the canister, taken generally on the line 18—18 of FIG. 16.
Figure 19:
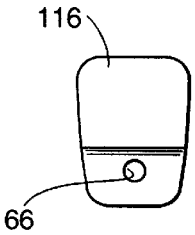
FIG. 19 is a front elevation view of the solid slug, taken generally on the line 19—19 of FIG. 13.
Figure 24:
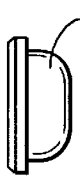
FIG. 24 is a top plan view of the canister cap, taken generally on the line 24—24 of FIG. 23.
Figure 20:
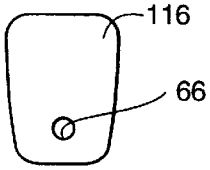
FIG. 20 is a rear elevation view of the solid slug, taken generally on the line 20—20 of FIG. 13.
Figure 21:
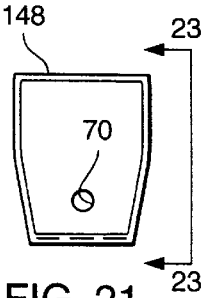
FIG. 21 is a front elevation view of a canister cap for mounting onto a rear open end of the canister, taken generally on the line 21—21 of FIG. 13.
Figure 23:
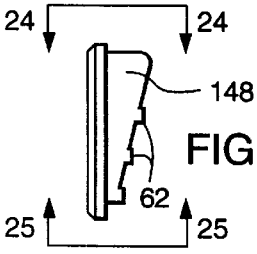
FIG. 23 is side elevation view of the canister cap, taken generally on the line 23—23 of FIG. 22.
Figure 22:
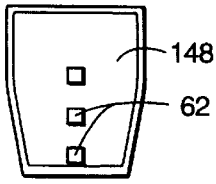
FIG. 22 is a rear elevation view of the canister cap, taken generally on the line 22—22 of FIG. 13.
Figure 25:
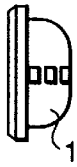
FIG. 25 is a bottom plan view of the canister cap, taken generally on the line 25—25 of FIG. 23.

As shown in FIGS. 10–12, the modified hammer 110 has a general shape and construction similar to the hammer 10 shown and described in FIGS. 1–9, with the tool head 112 including a central body 128 defining a front impact member 122 having an impact face 124 thereon and a rear nail removal claw 126. The central body 128 of the tool head 112 has the hollow socket 114 formed therein with an upwardly open configuration (FIG. 12). A lower or base end of the socket 114 includes a handle port 138. The handle port 138 is generally aligned on a vertical center axis of the socket 114, and has a cross sectional area which is significantly less that the open cross sectional area defined by the top of the socket. The internal wall surfaces of the tool head 112 lining the socket 114 include a front wall 130, a rear wall 132, and a pair of side walls 134, all of which taper downwardly and inwardly to provide the socket 114 with a truncated conical shape.

The solid slug 116 is movably mounted within a hollow canister 118 which is adapted for secure mounting into the hollow socket 114 of the tool head 112. More particularly, as shown best in FIGS. 13–18, the canister 118 comprises a hollow case or core having a open rear end for receiving the solid slug 116, and an exterior geometry for secure slide-fit reception downwardly into the tool head socket 114. The canister 118 may be formed from a selected sturdy material such as metal or plastic and, in a preferred form, may include external ribs 62 as shown for gripping and tightly engaging the internal wall surfaces lining the socket 114. In this regard, the canister 118 has a generally truncated conical external configuration closely matching the geometry of the tool head socket 114.

The solid slug 116 is formed from a selected high mass material, such as steel or the like. The slug 116 has a size and shape for slide-fit reception into the hollow canister 118 for sliding fore-aft movement generally along an axis coincident with a main fore-aft axis of the tool head 112, substantially without lateral shifting movement within the tool head. Accordingly, as viewed in FIGS. 19–20, the solid slug 116 has a transverse cross sectional size and shape corresponding generally with the transverse cross sectional size and shape of the canister interior, as viewed in FIG. 15. Importantly, the solid slug 116 is restrained within the canister 118 by a guide rail 64 which also extends along a fore-aft axis generally coincident with a main fore-aft axis of the tool head 112, in the direction of an impact force when a target surface is struck by the front impact face 124 of the impact member 122. This guide rail 64 is shown in the form of a guide pin extending through an open bore 66 formed in the solid slug 116, with opposite ends of the guide pin being respectively seated within small counterbores 68 and 70 formed a front canister wall 146 and a rear cap or end plate 148 (FIGS. 22–25) assembled with the canister 118 to close the rear end thereof. The guide rail or pin 64 prevents the solid slug 116 from shifting radially outwardly within the canister 118 in response to centrifugal force as the hammer is swung during use, to correspondingly prevent the solid slug 116 from applying any significant force or load to a top canister wall 72. However, the guide rail or pin 64 permits substantially unimpeded fore-aft shifting motion of the slug 116 within the canister 118.

After the solid slug 116 is slidably mounted within the canister 118, with the rear end plate 148 closing the canister, the canister 118 is assembled with a tool handle 120. In this regard, a lower or bottom wall 152 of the canister is shown to include a downwardly open aperture 74 for secure attachment to an upper end of the tool handle 120 by means of welding or the like. The tool handle 120 is then fitted downwardly through the open socket 114 formed in the tool head 112 to a position with the slug-filled canister 118 seated tightly and securely within the socket. A retainer ring 76 (FIGS. 10–12) may be secured by welding or the like to the tool head 112 and the tool handle 120 at the handle port 138 to assist in securely locking the components in place. A resilient hand grip 156 can be mounted onto a lower region of the handle 120.

In use, when the hammer 110 is swung by a worker to apply a blow via the front impact face 124 to a selected target surface, the direction of swinging motion causes the solid slug 116 to shift rearwardly within the canister to a position abutting the rear canister end plate 148. During this swinging motion, the guide pin 64 constrains the slug 116 against radially outward displacement attributable to centrifugal force and thereby prevents the slug from applying any significant load to the top wall 72 of the canister. In this regard, repeated application of a significant force by the slug 116 to the top wall 72 could otherwise cause wear and eventually contribute to failure of the top wall 72. Moreover, in the course of abusive usage, the top wall 72 of the canister 1 18 could become damaged. Such wear and/or damage to the top wall 72 could undesirably allow the solid slug 116 to fly outwardly from the tool head 112 in an uncontrolled manner during swinging of the hammer. The guide rail or pin 64 prevents this failure mode.

At the moment of impact, the solid slug 116 shifts forwardly within the canister 118 along the axis of the guide rail or pin 64, and thus generally along the main fore-aft axis of the tool head 112 in alignment with the direction of the blow. The forward-shifting slug 116 impacts the front end 146 of the canister 118 to focus the impact energy on the target surface, such that reduced force is available for causing any significant recoil or rebound following the impact blow. Thus, as in the embodiment of FIGS. 1–9, an increased proportion of the impact energy for each blow is applied to the target surface to increase hammer efficiency while decreasing worker fatigue.

A variety of further modifications and improvements in and to the nonrecoil hammer of the present invention will be apparent to those persons skilled in the art. Accordingly, no limitation on the invention is intended by way of the foregoing description and accompanying drawings, except as set forth in the appended claims.

What is claimed is:

1. A nonrecoil hammer, comprising:

a metal tool head defining at least one impact member and including a central body having an open socket formed therein, said tool head defining a main fore-aft axis;

a movable filler material of relatively high mass contained within said tool head socket, said movable filler material comprising a solid slug;

a guide rail extending generally along said main fore-aft axis and slidably engaging said solid slug for constraining said solid slug to movement generally along said main fore-aft axis; and a handle coupled to said tool head and extending downwardly therefrom;

wherein said open socket is upwardly open within said central body of said tool head and has a generally truncated conical shape, and further including a hollow canister having said solid slug slidably contained therein, said canister being nestably seated within said socket.

2. The nonrecoil hammer of claim 1 wherein said metal tool head comprises a steel tool head.

3. The nonrecoil hammer of claim 1 wherein said at least one impact member comprises a pair of front and rear work members disposed generally at opposite front and rear ends of said central body.

4. The nonrecoil hammer of claim 3 wherein said front and rear work members respectively comprise a front impact member defining a front impact face, and a rear nail removal claw.

5. The nonrecoil hammer of claim 1 wherein said socket has a lower end defining a downwardly open handle port, said handle being connected to said canister and extending therefrom through said handle port and downwardly from said tool head.

6. The nonrecoil hammer of claim 1 wherein said canister defines a pair of end faces at opposite ends thereof for tight abutting engagement respectively a pair of opposed end walls lining said socket, when said canister is nested within said socket.

7. The nonrecoil hammer of claim 1 wherein said guide rail comprises a guide pin mounted within said canister to extend generally along said main fore-aft axis when said canister is nested within said socket, said guide pin extending through a bore formed in said solid slug.

8. The nonrecoil hammer of claim 7 wherein said canister has an open-ended construction for slide-fit reception of said solid slug, and further including an end cap for assembly with said canister to enclose said solid slug therein, said guide pin having opposite ends supported respectively by said canister and said end cap.

9. The nonrecoil hammer of claim 1 wherein said guide rail comprises a guide pin mounted within said socket to extend generally along said main fore-aft axis, said guide pin extending through a bore formed in said solid slug.

10. The nonrecoil hammer of claim 1 further including a resilient hand grip mounted on a lower region of said handle.

11. A nonrecoil hammer, comprising:

a metal tool head including a central body having an upwardly open socket formed therein and further defining at least one impact member formed on a front end of said central body, said tool head defining a main fore-aft axis;

said open socket being lined by a pair of generally upstanding front and rear end walls joined to a pair of generally upstanding opposed side walls, and a support surface having a handle port formed in a lower end thereof;

a hollow canister having a size and shape for substantially nested reception into said socket, seated upon said support surface and including front and rear end faces on said canister for relatively tight and substantially mating abutted fit respectively with said front and rear end walls lining said socket;

a movable filler material comprising a solid slug of relatively high mass slidably contained within said canister;

a guide rail extending generally along said main fore-aft axis and slidably engaging said solid slug for constraining said solid slug to movement generally along said main fore-aft axis; and a handle coupled to said canister and extending downwardly from said canister and through said handle port when said canister is nested within said socket.

12. The nonrecoil hammer of claim 11 wherein said metal tool head comprises a steel tool head.

13. The nonrecoil hammer of claim 11 wherein said tool head further includes a rear work member formed on a rear end of said central body generally in alignment with said impact member, said front and rear end walls within said socket being disposed generally in alignment with said impact member and said rear work member.

14. The nonrecoil hammer of claim 13 wherein said impact member and said rear work member respectively comprise a front impact member defining a front impact face, and a rear nail removal claw.

15. The nonrecoil hammer of claim 11 wherein said guide rail comprises a guide pin mounted within said canister to extend generally along said main fore-aft axis when said canister is nested within said socket, said guide pin extending through a bore formed in said solid slug.

16. The nonrecoil hammer of claim 15 herein said canister has an open-ended construction for slide-fit reception of said solid slug, and further including an end cap for assembly with said canister to enclose said solid slug therein, said guide pin having opposite ends supported respectively by said canister and said end cap.

* * * * *

UNITED STATES PATENT AND TRADEMARK OFFICE

CERTIFICATE OF CORRECTION

PATENT NO. : 6,234,048 B1
DATED : May 22, 2001
INVENTOR(S) : Joseph Allen Carmien It is certified that error appears in the above-identified patent and that said Letters Patent is hereby corrected as shown below:

Claim 16,
Line 1, replace the word "herein" with -- wherein --.

Signed and Sealed this

Fifth Day of March, 2002

*Attest:*

*Attesting Officer*

JAMES E. ROGAN
*Director of the United States Patent and Trademark Office*